US009815532B2

(12) United States Patent
Shumate et al.

(10) Patent No.: US 9,815,532 B2
(45) Date of Patent: Nov. 14, 2017

(54) DEVICE FOR DETECTING DISLOGDED ANCHORING APPARATUS AND THE LIKE

(71) Applicants: Rodney Scott Shumate, Burke, VA (US); Steven Hampl, Triangle, VA (US)

(72) Inventors: Rodney Scott Shumate, Burke, VA (US); Steven Hampl, Triangle, VA (US)

( * ) Notice: Subject to any disclaimer, the term of this patent is extended or adjusted under 35 U.S.C. 154(b) by 0 days.

(21) Appl. No.: 15/252,186

(22) Filed: Aug. 30, 2016

(65) Prior Publication Data

US 2017/0057603 A1 Mar. 2, 2017

Related U.S. Application Data

(60) Provisional application No. 62/211,821, filed on Aug. 30, 2015.

(51) Int. Cl.

| | |
|---|---|
| ***G08B 3/00*** | (2006.01) |
| ***B63B 45/00*** | (2006.01) |
| ***B63B 21/24*** | (2006.01) |
| ***B63B 21/02*** | (2006.01) |
| *B63B 21/00* | (2006.01) |

(52) U.S. Cl.

CPC ..... *B63B 45/00* (2013.01); *B63B 21/02* (2013.01); *B63B 21/24* (2013.01); *B63B 2021/008* (2013.01); *B63B 2201/02* (2013.01); *B63B 2201/04* (2013.01)

(58) Field of Classification Search

None

See application file for complete search history.

(56) References Cited

U.S. PATENT DOCUMENTS

| | | | | |
|---|---|---|---|---|
| 4,912,464 A * | 3/1990 | Bachman | ..... | B63B 21/22 114/293 |
| 5,445,103 A * | 8/1995 | Bleth | ..... | B63B 21/22 114/293 |
| 6,374,765 B1 * | 4/2002 | Marotta | ..... | B63B 21/22 114/293 |

(Continued)

*Primary Examiner* — Julie Lieu

(74) *Attorney, Agent, or Firm* — Isaac Angres

(57) ABSTRACT

The present invention provides an anchor alarm device which is a manually deployed weighted device attached to or near the anchor which signals to device equipment at water-level. The device detects the movement of, or physical force generated by, a dislodged anchor. When deployed, a component of the anchor alarm device rests adjacent to or as part of a seated anchor at a distance predetermined by the tolerance of the secondary rode. The secondary rode connects the device directly to the anchor, or near the anchor on the primary rode. Upon displacement of the set anchor, in excess of the secondary rode, the device alerts the user. The device utilizes sensor monitoring inside of a housing component to detect a force indicative of anchor displacement. This detection triggers a signals emission which alerts the user of the change in position. In cases wherein the anchor is not immediately retrieved, device re-arms autonomously and stops emission of the alarm signal until the next anchor displacement. The system communicates with signal devices on board or deployed near the anchoring vessel in order to alert the user.

11 Claims, 3 Drawing Sheets

(56) References Cited

U.S. PATENT DOCUMENTS

| | | | | |
|---|---|---|---|---|
| 6,472,983 | B1 * | 10/2002 | Grunder | B63B 21/00 340/531 |
| 9,250,082 | B2 * | 2/2016 | Frizlen | B63B 21/22 |
| 2005/0241558 | A1 * | 11/2005 | Barlow | B63B 21/04 114/200 |
| 2008/0251000 | A1 * | 10/2008 | Blakesley | B63B 21/00 114/293 |
| 2011/0209652 | A1 * | 9/2011 | Bernloehr | B63B 21/26 114/230.13 |
| 2014/0352597 | A1 * | 12/2014 | Bailey | B63B 21/30 114/230.13 |
| 2015/0116496 | A1 * | 4/2015 | Ottaviano | H04N 7/185 348/148 |
| 2015/0274261 | A1 * | 10/2015 | Bauer | B63B 21/26 701/21 |
| 2017/0066508 | A1 * | 3/2017 | Bailey | B63B 21/30 |

* cited by examiner

DEVICE FOR DETECTING DISLOGDED ANCHORING APPARATUS AND THE LIKE

This application claims the priority benefit under 35 U.S.C. section 119 of U.S. Provisional Patent Application No. 62/211,821 entitled "Triggered Anchor Alarm" filed on Aug. 30, 2015, and which is in its entirety herein incorporated by reference.

FIELD OF THE INVENTION

The instant invention relates to an anchoring alarm, especially for boats. The present invention further relates to an anchor and anchor chain trigger alarm device for anchored floating objects, in particular ships and leisure boats. The invention additionally relates in general to ship anchoring systems and in particular to a system for monitoring performance of a ship's anchoring system and for producing usable data and alarms when the anchoring system fails.

This invention further relates generally to alarm systems and more particularly to an apparatus for indicating movement of a boat relative to a given position where it may be moored or otherwise secured. Although the invention will be described from the standpoint of boat drift resulting from anchor drag, it will be appreciated that the apparatus is equally adaptable to indicating object drift above or under water which comes as a result of mooring dislodgement or the like.

The instant invention pertains to means for promoting safety of a marine vessel at anchor, and more particularly, to means for providing a signal or alarm incident to dragging of an anchor relative to the bottom with which it is engaged.

This invention is the field of apparatus for detecting vessel movement in water. More specifically, it is in the field of such apparatus used for detecting unprovoked vessel movement as the result of such influences of water current, air movements, or improperly deployed anchoring. Such apparatus has been termed vessel movement detection or navigation in the past.

The invention further relates to anchoring alarm having an alarm arrangement designed to produce a noise and/or vibration and/or light signal.

The present invention also relates to an anchor position status system for boats, and more particularly to an anchor drift indicating system.

BACKGROUND OF THE INVENTION

Boat[S1] and marine vessel owners who use an anchor do so in order to rest or otherwise leave their boat, yacht or vessel unattended and unmonitored for periods of time. During these time periods, if the anchor was to fail, a number of things may happen (e.g., collision, running aground, etc.) that may damage the boat, cause it to sink, or result in the loss of life. The cost to repair a boat that has been damaged or under water, even briefly, can be significant. Marine vessels require anticipatory actions to maintain control and every moment can be crucial in ensuring the safe operation of the vessel. Commercial marine vessels can weigh hundreds of thousands of tons and recreational vessels can weigh just a few tons. Any drifting vessel can incur serious injury or death in addition to any damage to property and cargo.

Moreover, boat owners know these risks are present and are generally concerned about their unattended or unmonitored boats. A deployed anchor can generate a significant deal of anxiety due to the uncertainty of the anchor's status or proper seating. Currently, there is no comprehensive system which can directly convey the status of the anchor when properly seated or when dislodged.

When a boat is stopped and it is desired that it remain in one place, an anchor is dropped. The anchor flukes engage or dig into the bottom to secure the boat in position for as long a period as it desired. High winds, turbulent waters or shifts in tide or current can cause the anchor to become freed from the bottom and to drag. When this occurs, the boat is no longer secured in position and drifts, creating a potentially dangerous, and often an emergency, situation for the crew.

It is readily apparent that if the anchor is so released and is dragging, the crew of the boat must be quickly alerted. This is especially true during the night hours when the crew may be sleeping.

The problem of anchor dragging is somewhat complicated by the fact that the boat may swing around the anchor if the wind or tide changes but the anchor may still dig into the bottom and hold the boat in position. It may well be desirable that an alarm be given when an anchor is significantly jolted but not otherwise dislodged, so that the crew can be alerted to check the situation if appropriate, but an alarm given upon this occurrence should be readily distinguishable from the alarm indicating actual anchor dragging. Any change in the anchor's status, when not anticipated, is a serious problem which must be brought promptly to the attention of the crew.

In a rare number of cases, the anchor may be dug into the bottom where the bottom has an excessively steep downward declivity. This creates a tenuous and insecure retention of the anchor in the bottom which greatly increases the possibility of the anchor dragging when compared to the situation in which the anchor engagement with the bottom is made at a more level location. Thus an alarm indicating the engagement of the anchor with an excessively sloping part of the bottom is also useful to inform the crew that it is anchoring in a potentially dangerous location.

The problem of monitoring a possible drift of a vessel that lies at anchor, especially in darkness and in bad weather conditions, is known of old and has led to the institution known to the professionals as anchor watch. This comprises the periodic check of the ship's exact position by a member of the crew, usually by taking sights of landmarks. However, this solution is not entirely adequate for the crews of the present-day, and implausible for recreational boaters. Moreover, the crews of the present day rely on equipment and therefore lack the experience necessary to detect the necessary movement by sight alone. Modern day Global Positioning System (GPS) enabled boat movement alarms require significant shift which would exceed nearly twice the range of the rode deployed to seat the anchor. The traditional and modern attempts to protect vessels and crew ensure that successfully anchoring a vessel is still largely left up to chance.

Reliable anchoring is an important requirement for all kinds of water vessels, in particular rafts, boats, and ships, but also floating platforms and other semi-stationary objects. If one or more anchors come loose, significant damage can result to the water vessel, other water vessels, and/or crew, passengers etc.

There have been many instances in which a boat, when anchored for the night, has drifted away from its original position due to the anchor having lost its holding engagement with the bottom and dragging thereacross under the influence of waves and wind on the boat. This condition can, of course, create a dangerous situation for the boat and its occupants who may be unaware that the anchor is dragging.

As is well understood by those skilled in the marine arts, a vessel at anchor is subject to the vagaries of movements of the water and the atmosphere. As a consequence, a constant watch is maintained on vessels of any appreciable size, whereby timely warning may be given of adverse change of conditions so that proper action may be taken. In the case of many vessels, especially small vessels, maintenance of a continuous watch during periods of open anchorage is uneconomical or impractical. In such cases, need for an automatically-acting means capable of initiating or producing an alarm or signal is evident. The present invention provides means for producing a signal incident to dragging of an anchor or significant motion of an anchor; and when embodied in its most complete physical form the invention provides means for producing a sense-perceptible signal or alarm at a selected location on the vessel, or, alternatively, at a location distant from the vessel[S2].

Accordingly, there is a need for an efficient and timely monitoring system that enables vessel/boat owners to monitor their vessel's/boat's mooring status and receive warning when that status changes.

OBJECTS OF THE INVENTION

It is a primary object of the present invention to provide an anchor drift alarm system for a vessel having an anchor of any size.

It is a further object of the present invention to provide an anchor-dragging alarm for use on boats which provides a warning of anchor movement.

It is another object of the present invention to provide an anchor alarm which provides an indication when the anchor is dug into the bottom safely.

Another object of the invention includes a re-latching feature which allows for an unseated anchor to be monitored at the discretion of the crew without necessarily having to retrieve and redeploy the anchor in order to detect persistent dislodgement.

It is also an object of the present invention to provide a lightweight, economical, and reliable anchor alarm system which can be readily incorporated onto the anchor design conventionally utilized on ships and boats.

With the foregoing in mind, it is also a primary object of this invention to provide an apparatus in combination with a conventional horn or other mechanisms for automatically actuating a boat-mounted alarm in response to dragging movement of the anchor with respect to the bottom of the water to the end that the occupants of the boat are made aware that the boat is drifting.

Another object is to provide a means for accomplishing the foregoing object wherein the alarm or horn continues to sound after being actuated, thus requiring that an occupant of the boat manually turn it off, and thereby insuring that the occupant will be awakened to investigate the position of the boat.

Another object is to provide an alarm system which may be combined with a conventional manually actuated or automatic activated horn mechanism and used in conjunction with the existing electrical system of a boat.

Yet another object of the invention is to provide an alarm system capable of providing a continuous anchor status through visual graphics, lights, or other mechanisms.

The objects and advantages of this invention are attained by providing a component which connects to the anchor and houses an array of sensors capable of monitoring physical force indicative of anchor movement and communicating with a water-level receiver by means of acoustic or radio transmission. The component houses an electromagnetic latch and control system capable of resetting itself when a user intends to monitor a moving anchor as opposed to completely retrieving and resetting the anchor. The water-level sensor, whether on the boat or in the water, receives communications from the housing component and, in turn, actuates the signal, status and/or horn device aboard the vessel or otherwise with the crew.

A better understanding of the invention will now be had by referring to a preferred embodiment thereof as illustrated in the accompanying drawings.

SUMMARY OF THE INVENTION

Figure 1:
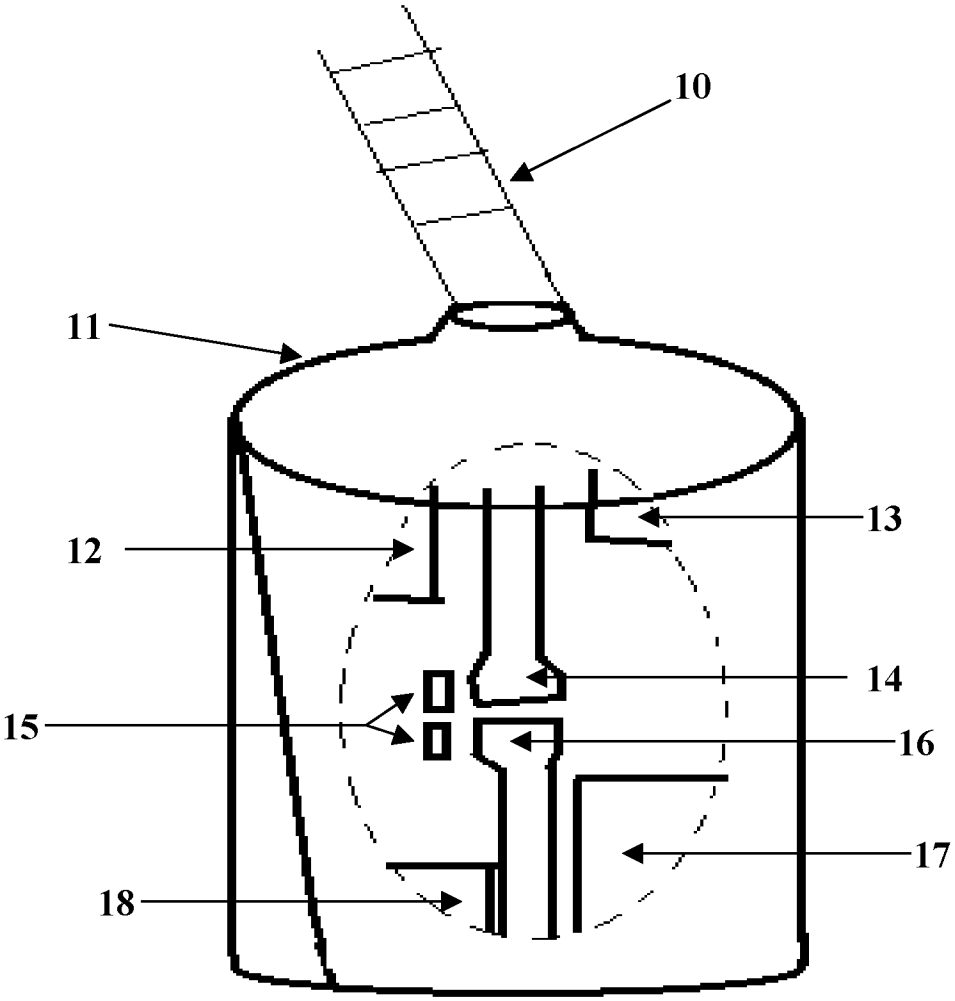
FIG. 1 is a perspective view of a crosscut subject housing in an embodiment wherein the device is housed separate of the anchor itself.

The prior art has largely concerned itself with the problem of locating and retrieving anchors; however, an unaddressed problem is that of determining whether secure anchorage occurs. If an anchor fails to secure itself securely on the ocean bottom or the like, it is possible for the associated vessel to drift imperceptibly, dragging its anchor along the bottom. Of course, the principles presented herein apply equally to all navigable bodies of water: for brevity, the terms "ocean" and "ocean bottom" will be understood to encompass all such bodies of water. In areas near dangerously shallow bottoms, submerged rocks, the shoreline, other vessels, or mooring or fishing lines, this drift is unacceptable. It therefore is desirable to determine whether the anchor is drifting in addition to determining the status of the anchor by using a suitable alarm system that is practical.

This invention relates generally to the apparatus for anchoring ships and more particularly to an alarm means associated therewith to indicate movement of an anchored ship beyond a prescribed distance.

The present invention is capable of use in any situation where movement of an underwater structure can be sensed and signaled. One example is in a boat anchor where it is highly desirable to be notified if the anchor is dislodged and drags.

The instant invention is directed to a triggered anchor alarm housing component that is a manually deployed weighted device attached to or near the anchor. The triggered anchor alarm detects the physical force generated by a dislodged anchor. When deployed, the triggered anchor alarm rests adjacent to, or as a section of, a seated anchor at a distance predetermined by the tolerance of the secondary rode. The secondary rode connects the triggered anchor alarm directly to the anchor, or near the anchor on the primary rode. Upon displacement of the set anchor in access of the secondary rode, the triggered anchor alarm alerts the user. The triggered anchor alarm utilizes sensor monitoring inside of a housing component to detect a force which is indicative of anchor displacement. This detection triggers a one-way emission which alerts the user of the change by means of a water-level receiver. In cases wherein the anchor is not immediately retrieved, the triggered anchor alarm autonomously re-arms via an electromagnetic latch and control mechanism and stops emission of the alarm signal until anchor displacement.

The triggered anchor alarm includes the following components: the exterior line, the housing component, the interior sensors, the interior line, the electromagnetic latch, the power source, the transmitter, the electronic switch, and the weight.

The exterior line, or secondary rode, is comprised of two portions which attach via both a non-loadbearing electromagnetic latch when armed and load-bearing interior lines when tripped. The housing component is a protective waterproof capsule which houses the interior sensors, part of the exterior line, the interior lines, the power source, the electromagnetic latch, the antenna, and the electronic switch. The exterior shell of the housing component rests on a free spinning axis as to diminish drag on a deployed triggered anchor alarm and which allows for hydrokinetic charge for battery regeneration.

The interior lines, or load bearing lines, connect both portions of the exterior line upon the separation of the electromagnetic latch. The primary function of the interior line is to ensure recovery of the triggered anchor alarm after the alarm has been triggered.

The electromagnetic latch adjoins both portions of the exterior line when closed and helps trigger the alarm when opened by the force of the dragging weight. The latch consists of electrically charged soft iron wrapped in coiled copper wiring indicative of a Perpetual Motion Holder. The latch is activated on a timer via electronic charge and resets after a set delay. The two pieces of iron are each fitted with sensors (infrared, magnetic, etc.) whose misalignment triggers the alarm's activation.

The power source consists of either primary or rechargeable batteries and a waterproof battery chamber. The rechargeable source may benefit from hydrokinetic charge generated by the rotation of the housing component's exterior shell. The rechargeable source may benefit from the use of induction cables aligned through the device casing for more convenient recharging. The power source provides power to the timer, the magnetic latch, and the antenna.

The transmitter emits low frequency sound or radio signal to a receiver in order to alert the user of a triggered Alarm/dislodged anchor.

The electronic switch acts as a timer for deployment and redeployment, triggers the electronic charge necessary for the magnetic latch, receives information regarding sensor displacement, and triggers emission of the alarm signal via the antenna.

The weight allows the triggered anchor alarm to sit adjacent to the anchor until anchor displacement and creates the tension required to displace sensors in the housing component.

The invention further provides an anchor alarm system for maritime ships comprising: (a) a secondary rode; (b) a housing attached to said secondary rode; said housing including: (i) electronic circuitry that controls timing for deployment, setting, redeployment and information gathering from other devices; (ii) a signal generating device which is activated by said electronic circuitry; (iii) one or more latching mechanisms; (iv) sensing devices attached to said latching mechanism; (v) a battery module; and (vi) means for reducing buoyancy and (c) one or multiple water-level receivers which can alert the user of the anchor status by means of visual, kinetic, or audible stimulus.

The invention also provides an apparatus for signaling an alarm when an anchor system, including an anchor connected to a ship at sea via a rode, fails to hold the ship in place, the apparatus comprising: component housing sensors attached to a latching mechanism used in detecting displaced sensors indicative of a displaced latch indicative of a moving anchor; a motion sensor for producing a second output signal indicating motion; and monitoring and alarming means for monitoring said first and second output signals and for signaling said alarm in response to a combination of time varying behavior of motion and latch displacement indicated by said first and second output signals.

The invention further provides an anchor alarm system for anchored floating objects, and in particular ships, having: a measuring means for measuring at least one tension force condition occurring on at least one position of an anchor chain between said anchor and said floating object, said measuring means employing at least one sensor to record the at least one condition and emitting an electrical signal characteristic of said condition or conditions, said sensor being positioned in a housing component attached to said anchor by means of a secondary rode and measuring tension exerted on the anchor by means of the said anchor chain; transmitting means which receives said data apparent from said measuring means and which transmits a signal corresponding thereto; and an alarm output and operating means which receives said signals emitted by said transmitting means and issues a status report or a warning alarm when the measured condition or conditions exceed a predetermined critical value.

The anchor alarm according to the present invention consists of a transmitting means and a separate alarm output means. This configuration has the advantage that the alarm output means, which is usually directly combined with an actuator, for example a warning light or a siren, can be stored in the range of vision and/or hearing of the user on board a ship or on land.

DETAILED DESCRIPTION OF THE INVENTION

The problematic nature of anchors for floating objects will first be described using the example of an anchored ship. To anchor, a ship lowers an anchor hanging on an anchor chain or hawser onto the waterway bottom so that the anchor, as well as also a large portion of the anchor chain/hawser lies on the sea bottom. What is important here is that the fixation of the ship at a certain area is not affected through the anchor connecting with the sea floor, but rather through the weight imposed on the portion of the anchor chain/hawser lying on the sea floor.

An anchored ship thus can, within a certain given range, move freely about the leverage point of the anchor chain on the sea bottom biasing the ship, thereby allowing for some give against external forces acting on the ship, as for example the force of currents or winds. As the amount of such external forces acting on the ship increase, this may led to the reaching of a particular condition, dependent upon a value based on weight and the length of the anchor chain, in which the anchor chain no longer lies on the sea bed and a force or motion is exerted directly from the ship to the anchor over the anchor chain. The ship either then drags the anchor unchecked behind itself or, should the anchor be firmly hooked on the waterway bottom, can give rise to the anchor chain breaking or the anchor itself fracturing so that the ship then flounders unchecked and uncontrolled in the waterway and could possibly run aground.

A situation of this sort is of course extremely dangerous, in particular when the wind direction is towards shore, or when the ship is located in an area having reefs, or when there are other potential shipping channel collision spots in the near vicinity.

Accordingly, it is the task of the present invention to provide an anchor chain, anchor motion and anchor force monitoring device i.e., an alarm system which increases the level of safety for an anchored floating contrivance.

More specifically, the present invention provides an anchor alarm device which is a manually deployed weighted device attached to or near the anchor. The device detects the movement of, or physical force generated by, a dislodged anchor. When deployed, the anchor alarm device rests adjacent to or as part of a seated anchor at a distance predetermined by the tolerance of the secondary rode. The secondary rode connects the device directly to the anchor, or near the anchor on the primary rode. Upon displacement of the set anchor, in excess of the secondary rode, the device alerts the user. The device utilizes sensor monitoring inside of a housing component to detect a force indicative of anchor displacement. This detection triggers a signals emission which alerts the user of the change in position. In cases wherein the anchor is not immediately retrieved, device re-arms autonomously and stops emission of the alarm signal until the next anchor displacement. The system communicates with signal devices on board or deployed near the anchoring vessel in order to alert the user.

In an embodiment which is expected to find most general use, the device is comprised of components such as the secondary rode, the housing component, the interior line, the latching device, the interior sensors, the power source, the signaling mechanism, the electronic circuitry, and the weight for reducing buoyancy. The secondary rode attaches the device housing component to the deployed anchor and acts as, or is otherwise attached to, the exterior line. The rode is encompassed in, or attaches to, a protective diaphragm which allows tension changes while ensuring the waterproof integrity of the device components. In an embodiment wherein the invention is housed in a section of the anchor itself, the secondary rode may extend to a range, or tolerance, between six and forty-eight inches. In an embodiment wherein the invention is protected by a housing component separate of the anchor, the secondary rode may extend to a range, or tolerance, between eight and sixty inches. The housing component is a protective capsule which contains the interior sensors, exterior line, the interior lines, the power source, the latching device, the signaling mechanism, and the electronic circuitry. The interior lines connect the exterior line and the weight upon separation of the latching device. The primary function of the interior line is to ensure recovery of the invention after the alarm has been triggered. The latch adjoins the exterior line and weight when closed and triggers the alarm when opened by the force of the dragging weight. The latch is fitted with sensors (infrared, magnetic, motion detecting, etc.) whose misalignment, or changing alignment, triggers the device's electronic circuitry and activation of the signal mechanism. The power source, or battery, provides power to the electronic circuitry, the latching device, and the signaling mechanisms. The signaling mechanisms emit signal such as radio frequency, sound, and/or light to a receiving device in order to alert the user of the detected anchor displacement. The electronic circuitry acts as a timer for deployment and redeployment, facilitates the electronic charge necessary for the latching devices, receives information regarding sensor displacement and motion, and triggers emission of the signal mechanisms. The weight aids the device in recognizing anchor displacement or movement, and creates the tension required to displace or align sensors in the housing component. The device emits signal detected by the receiver equipment attached to or aboard the vessel. In this way, the device warns the user when the anchor becomes dislodged or exhibits movement.

The invention is described below in more detail with reference to the attached drawings.

Referring first to FIG. 1, element 10 denotes a connection which is a secondary rode (wire, rope, chain or any other strong material capable of withstanding stresses from many direction without breaking), or exterior line, that is housed in a protected diaphragm which connects to the subject housing component. Structure 11 is the waterproof device housing (plastic or other suitable water impermeable material) component the material composition of which is comprised of layers of durable materials. Component 12 is the electronic circuitry (microprocessing equipment or microcontroller) which acts as a timer for deployment, setting, and redeployment, which receives information from device components, and which facilitates the electronic charge necessary for device actions. The interval of time transpiring between the measurement of condition and the transmission of signal is not constant, but rather varied by the microprocessor in accordance with a computing procedure during a pre-determined time domain. However, the signal transmission always transpires before the receipt of the next measurement. Element 13 denotes the signaling equipment (RF antenna or speaker or light signal, acoustic) that is activated by the device's electronic circuitry. Surface 14 is one, or half, of the parts related to the latching mechanism (electromagnetic latching-perpetual motion) and which is tied to force exerted on connection 10 and surface 16. Components 15 are sensor devices (reed switch, IR, motion, physical) attached to the latching mechanism surfaces depicted in an embodiment wherein the devices misalign to trigger the electronic circuitry activation of the signaling equipment. Surface 16 is one, or half, of the parts related to the latching mechanism and is tied to forces exerted on surface 14 and component 18. Element 17 denotes the battery power module which provides electric power to the device components and surfaces. The battery power module contains means by which the battery can be charged, replaced, and measured for battery life. Component 18 depicts the weighted object which negates the object buoyance and develops tension alternate to forces exerted by the exterior line.

Figure 2:
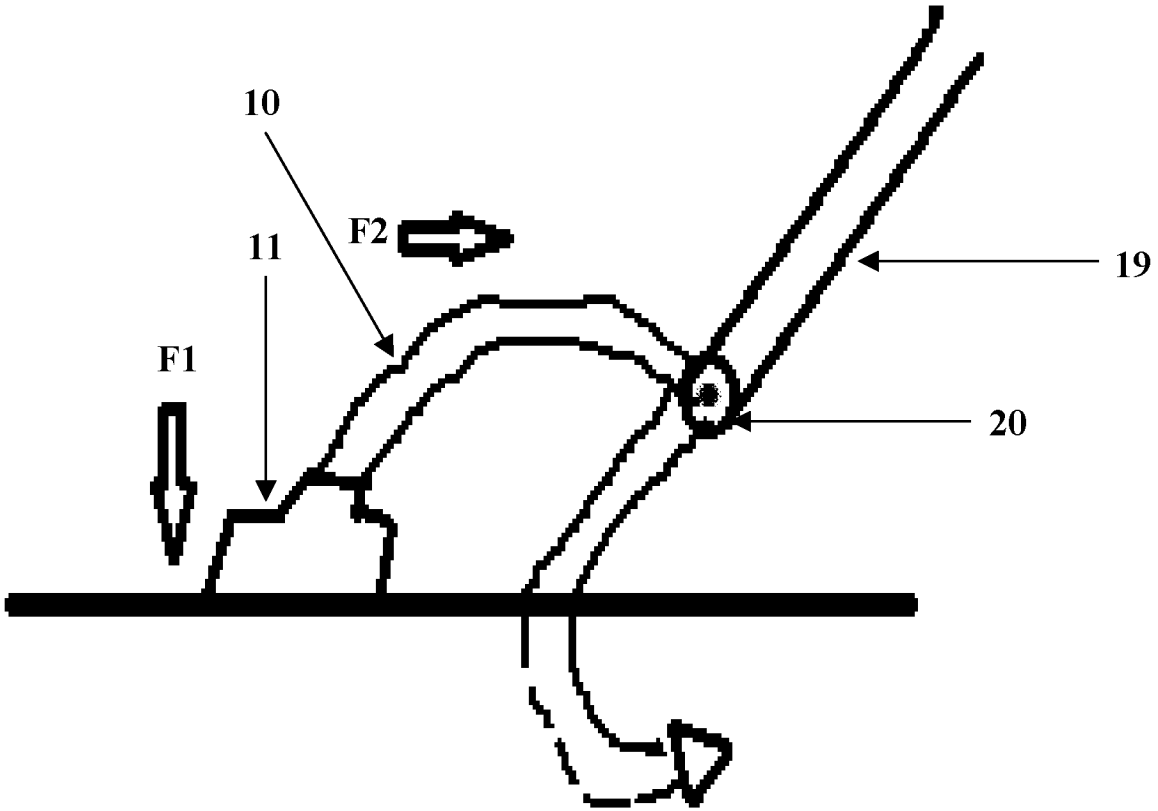
FIG. 2 is a sectional view of a set anchor attached to the subject secondary rode while the device is in a set state. The secondary rode is attached to housing in an embodiment wherein the device is housed separate of the anchor itself.

FIG. 2 illustrates a sectional view of a set anchor attached to the alarm of the invention by a secondary rode 10, or exterior line, when the device is in a set state. The figure depicts a housing component in an embodiment wherein the device is housed separate of the anchor itself. Element 19 is the primary rode attached to the anchor when the anchor is safely set aground. Component 20 shows the anchor as it is attached to connection 10 which binds the alarm of the invention to the anchor at a length of anywhere between eight and sixty inches, depending on the vessel.

Figure 3:
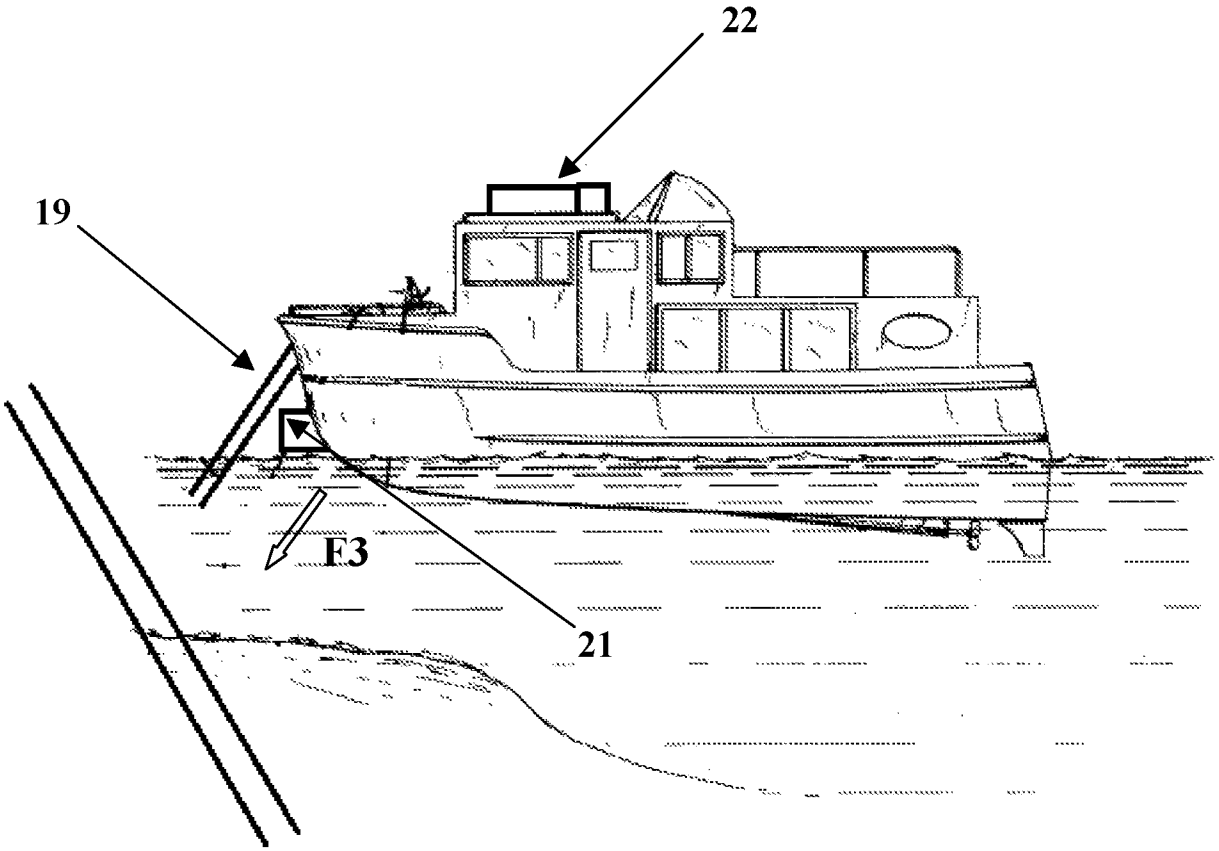
FIG. 3 is a perspective view of a vessel and conspicuously installed receiver equipment.

FIG. 3 is a perspective view of a vessel that has deployed an anchor and is equipped with the invention signal receiving equipment. Component 21 is receiving and transmission equipment in an embodiment wherein the receiving equipment is deployed at or below the water line. Component 22 is receiving equipment that emits warning to the vessel occupants when prompted by the invention signaling from components 13 and/or 21.

It is essential to the working of the invention that component 13 emits a signal when component 20 dislodges from being set aground. As element 20 moves, it will exert a force on connection 10 until the length of connection 10 is exhausted and surface 14 is forced to move. As surface 14 and surface 16 reflect this tension caused by connection 10, components 15 will prompt component 12 to initiate component 13. As a signal is provided by element 13, components 21 and 22 will receive signal indicating the anchor has been dislodged. Component 22 will notify the vessel occupants via a sounding alarm, satellite relay, electronic message, and/or through synchronized cellular device.

In addition to the all the previously mentioned components of the invention, the anchor alarm of the invention may also be fitted with special sensors that have a direct links to GPS (Global Positioning System). The initial position of the boat and anchor is recorded at the time of anchoring and based on pre-set geographical changes in position, the alarm system will also activate.

The electronic motion detector of the invention contains one or more of an optical, microwave, or acoustic sensor, and in some cases a transmitter for illumination. However, a passive sensor only senses a signal emitted by the moving object itself. Changes in the optical, microwave, or acoustic field in the device's proximity are interpreted by the electronics based on the chosen technologies. Most motion detectors can detect up to distances of at least 15 feet (5 meters). However, specialized systems have much longer ranges. There are several motion detection technologies that can be used such as passive infrared, microwave, ultrasonic, tomographic, video camera software, etc. Additionally, Dual-technology motion detectors can also be used. While combining multiple sensing technologies into one detector can help reduce false triggering, it does so at the expense of reduced detection probabilities and increased vulnerability. For example, many dual-tech sensors combine both a PIR sensor and a microwave sensor into one unit. In order for motion to be detected, both sensors must trip together. This lowers the probability of a false alarm since heat and light changes may trip the PIR but not the microwave. Often, PIR technology will be paired with another model to maximize accuracy and reduce energy usage. PIR draws less energy than microwave detection, and so many sensors are calibrated so that when the PIR sensor is tripped, it activates a microwave sensor.

The anchor alarm system of the invention may also include telemetry means that are transmitted to the boat owner via wireless means. Such telemetry would include many of the data points collected by the sensor system and sensing devices.

The sensor system of the invention may also include chemical sensors. The chemical sensor used with the sensor system of the invention is a self-contained analytical device that can provide information about the chemical composition of its environment, that is, a liquid, solid or a gas phase. The information is provided in the form of a measurable physical signal that is correlated with the concentration of a certain chemical species (termed as analyte). Two main steps are involved in the functioning of a chemical sensor, namely, recognition and transduction. In the recognition step, analyte molecules interact selectively with receptor molecules or sites included in the structure of the recognition element of the sensor. Consequently, a characteristic physical parameter varies and this variation is reported by means of an integrated transducer that generates the output signal.

In general, the chemical sensors that are useful with the sensor system of the invention are broadly classified into gas, liquid, and solid particulate sensors based on the phases of the analyte. They are further categorized as optical, electrochemical, thermometric, and gravimetric (mass sensitive) sensors according to the operating principle of the transducer.

Chemical sensors have become an indispensable part of our technology driven society and can be found in chemical process, pharmaceutical, food, biomedical, environmental, security, industrial safety, clinical, and indoor monitoring applications to highlight a few. Like many fields in science, chemical sensors have benefited from the growing power of computers, integrated electronics, new materials, novel designs, and processing tools. Manifestation of such technological Chemical Sensors changes can be seen in the development of miniaturized, inexpensive, portable, and mass manufacturable chemical sensors capable of static and continuous measurements even in remote environments.

All patents, patent applications and publications cited in this application including all cited references in those patents, applications and publications, are hereby incorporated by reference in their entirety for all purposes to the same extent as if each individual patent, patent application or publication were so individually denoted.

While the many embodiments of the invention have been disclosed above and include presently preferred embodiments, many other embodiments and variations are possible within the scope of the present disclosure and in the appended claims that follow. Accordingly, the details of the preferred embodiments and examples provided are not to be construed as limiting. It is to be understood that the terms used herein are merely descriptive rather than limiting and that various changes, numerous equivalents may be made without departing from the spirit or scope of the claimed invention.

What is claimed is:

1. An anchor alarm system for maritime ships comprising:

(a) a secondary rode; and (b) a housing attached to said secondary rode; said housing including: (i) electronic circuitry including microprocessors that controls alarm output means, timing for deployment, setting, redeployment and information gathering from other devices and sensors; (ii) a signal generating device which is activated by said electronic circuitry; (iii) one or more latching mechanisms; (iv) sensing devices attached to said latching mechanism; (v) a battery module; and (vi) means for reducing buoyancy.

2. The anchor alarm system of claim 1, which is directly or indirectly attached to, or designed as part of, an anchor.

3. The anchor alarm system of claim 1, wherein said sensing devices detect movement.

4. The anchor alarm system of claim 1, wherein said sensing devices detect the physical force generated by the dislodged anchor.

5. The anchor alarm system of claim 1, wherein said sensing devices include GPS.

6. The anchor alarm system of claim 1, wherein said sensing devices detects chemical changes in the environment of use.

7. The anchor alarm system of claim 6, wherein said sensing devices detects chemical changes in the mineral content of water.

8. The anchor alarm system of claim 6, wherein said sensing devices detects chemical changes in the mineral content of the soil under water.

9. The anchor alarm system of claim 1, wherein said latching mechanisms are electromagnetic latching mechanisms.

10. The anchor alarm system of claim 1, wherein said alarm output means has a microprocessor unit controlled by a program stored in a memory allocated to said alarm output means.

11. An apparatus for signaling an alarm when an anchor system, including an anchor connected to a ship at sea via a rode, fails to hold the ship in place, the apparatus comprising: component housing sensors attached to a latching mechanism used in detecting displaced sensors indicative of a displaced latch indicative of a moving anchor; a motion sensor for producing a second output signal indicating motion; and monitoring and alarming means for monitoring said first and second output signals and for signaling said alarm in response to a combination of time varying behavior of motion and latch displacement indicated by said first and second output signals.

* * * * *